US006142172A

United States Patent [19]

Shuler et al.

[11] Patent Number: 6,142,172

[45] Date of Patent: Nov. 7, 2000

[54] FREEZE PROTECTION DEVICE FOR WALL HYDRANTS/FAUCETS

[75] Inventors: James F. Shuler; Lawrence Almasy, both of Colorado Springs, Colo.

[73] Assignee: WCM Industries, Inc., Colorado Springs, Colo.

[21] Appl. No.: 09/444,101

[22] Filed: Nov. 22, 1999

[51] Int. Cl.[7] ..... E03C 1/10

[52] U.S. Cl. ..... 137/360; 137/59; 137/218; 137/614.2

[58] Field of Search ..... 137/218, 360, 137/614.2, 614.18, 59

[56] References Cited

U.S. PATENT DOCUMENTS

| | | | |
|---|---|---|---|
| 4,182,356 | 1/1980 | Woodford, Sr. | 137/59 |
| 4,212,319 | 7/1980 | Krablin | 137/614.2 |
| 4,286,616 | 9/1981 | Botnick | 137/327 |
| 4,700,732 | 10/1987 | Francisco . | |
| 4,821,762 | 4/1989 | Breneman | 137/218 |
| 4,909,270 | 3/1990 | Enterante, Sr. et al. . | |
| 5,590,679 | 1/1997 | Almasy et al. | 137/218 |
| 5,603,347 | 2/1997 | Eaton | 137/360 |
| 5,632,303 | 5/1997 | Almasy et al. . | |
| 5,740,831 | 4/1998 | DeNardo et al. | 137/218 |

*Primary Examiner*—A. Michael Chambers
*Attorney, Agent, or Firm*—Zarley, McKee, Thomte, Voorhees & Sease

[57] ABSTRACT

A freezeless wall hydrant/faucet has an inlet pipe with one end connected to a source of pressurized water, a water discharge conduit, and an elongated control rod extending through the inlet pipe to open and close a fluid valve. A bore is inserted through the fluid valve with the bore being in communication with both the source of pressurized water and the interior portion of the inlet pipe. A check valve is placed in the bore of the valve body to open only when extreme water pressure within the inlet valve moves a seated ball to permit the highly pressurized water to move through the bore in the valve body and be relieved as it escapes rearwardly into the original source of pressurized water.

4 Claims, 4 Drawing Sheets

FREEZE PROTECTION DEVICE FOR WALL HYDRANTS/FAUCETS

BACKGROUND OF THE INVENTION

Freezeless wall hydrants and faucets have long been in existence. They characteristically have a fluid closure valve located in the end of an inlet pipe located within the wall or a warmer interior area of the building of which the wall is a part. This closure valve is operated by an elongated rod connected to an exterior handle. The freezeless characteristics of the hydrant are caused by the closure valve shutting off the flow of water within the wall or building at a freezing temperature, with the residual water in the inlet pipe flowing by gravity outwardly through the conventional outlet drain of the hydrant.

The foregoing structure works very successfully except in situations where a hose or the like is attached to the outlet drain of the hydrant, whereupon the residual water is not able to easily flow by gravity out of the hydrant when the closure valve connected to the pressurized water is closed. With a hose attached during freezing weather, the residual water freezes within the hydrant, and the inlet pipe or related components thereupon rupture from the freezing conditions within the hydrant.

It has in recent times been recognized that the rupture of such a hydrant under freezing weather conditions does not take place because of the frozen water in the hydrant. Rather, the rupture results from the ice imposing severe pressure on the captivated non-frozen fluid in the inlet pipe. Thus, the increased pressure on this water by the expanded ice is the principal cause for the rupture of the hydrant.

Accordingly, it is a principal object of this invention to provide a freezeless wall hydrant which has the ability to drain at least some of the residual water in a hydrant when, under freezing conditions, the residual water towards the exterior part of the hydrant freezes by reason of a hose or the like being attached to the discharge nozzle.

It is a further object of this invention to provide a relief valve for the captured residual water under the foregoing conditions to escape back towards the supply of pressurized water when the frozen water in the exterior of the hydrant creates excessive pressure on the remainder of the residual water in the hydrant.

These and other objects will be apparent to those skilled in the art.

SUMMARY OF THE INVENTION

A freezeless wall hydrant has an inlet pipe with one end connected to a source of pressurized water, a water discharge conduit, and an elongated control rod extending through the inlet pipe to open and close a fluid valve. A bore is inserted through the fluid valve with the bore being in communication with both the source of pressurized water and the interior portion of the inlet pipe. A check valve is placed in the bore of the valve body and is spring loaded to open only when extreme water pressure within the inlet valve lifts a spring loaded ball to permit the highly pressurized water to move through the bore in the valve body and be relieved as it escapes rearwardly into the original source of pressurized water. The check valve is enclosed within a cylindrical housing and is force-fit into the bore of the valve body. The spring has a strength that it will open the bore to fluid flow in a rearward direction only when the pressure within the outlet portion of the inlet conduit is greater than that of the pressurized source of water normally located upstream from the valve closure. Other alternative ways of relieving the water pressure created by the presence of ice exist and include, for example, eliminating the spring and allowing water to dwell on each side of the ball whereupon high pressure on one side of the ball will allow the ball to move to balance that pressure.

DESCRIPTION OF THE PREFERRED EMBODIMENT

Figure 1:
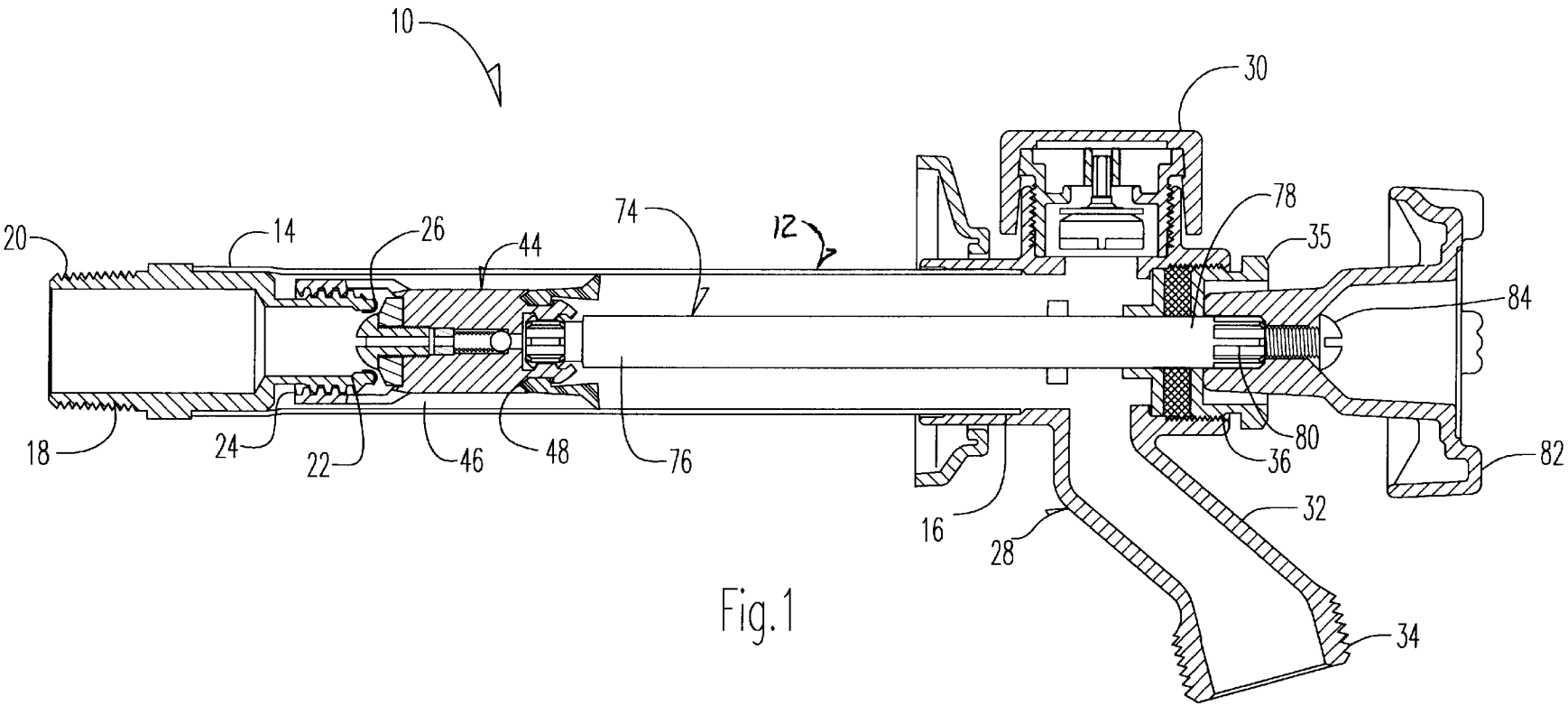
FIG. 1 is a longitudinal sectional view of the hydrant of this invention.

The hydrant 10 in FIG. 1 has an elongated hollow water inlet tube 12 which has an interior end 14 and an exterior end 16. A hollow valve fitting 18 is rearwardly secured to the interior end 14 of tube 12 and has a threaded end 20 adapted to be secured to a conduit connected to a source of pressurized fluid (not shown). The fitting 18 has an interior end 22 with external threads 24 and which terminate in a valve seat 26.

A casting member 28 has a conventional vacuum breaker 30 secured thereto and is rigidly connected to the exterior end 16 of inlet tube 12. A conventional fluid drain conduit 32 is located within casting member 28 and is in communication with the interior of tube 12. Conventional threads 34 are located on the discharge end of conduit 32 to receive a conventional hose or the like. Casting member 28 also has a threaded aperture 36 which is adapted to receive a conventional bushing 38 which in turn receives packing 40 which is held in tight engagement with bushing 38 by packing washer 42 (FIG. 1).

Figure 2:
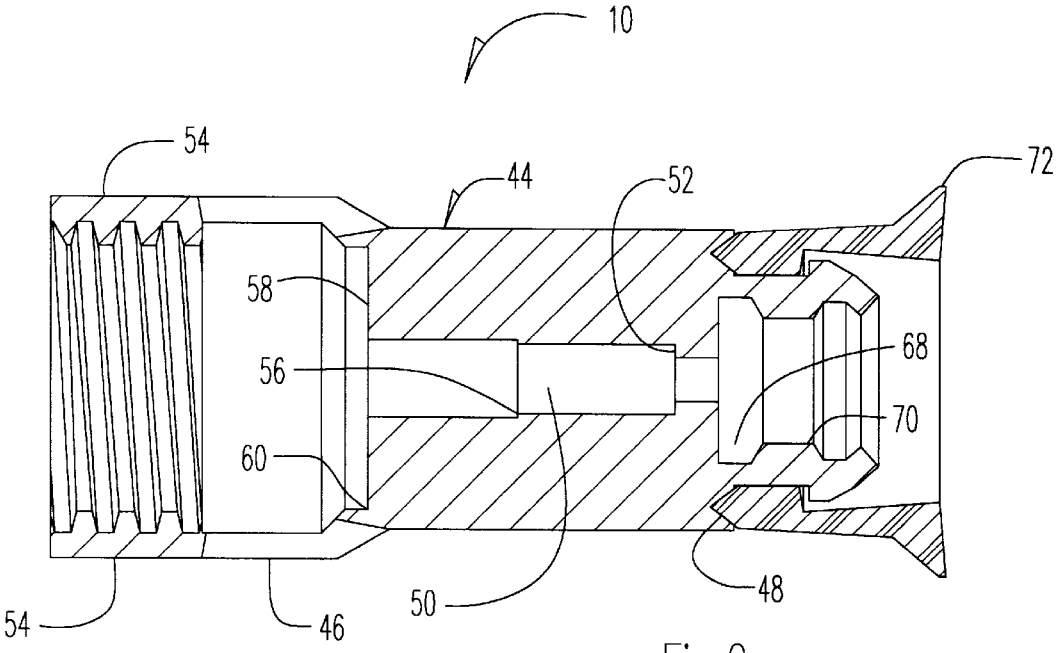
FIG. 2 is a large scale sectional view of the valve body which controls flow of pressurized water through the hydrant.
Figure 3:
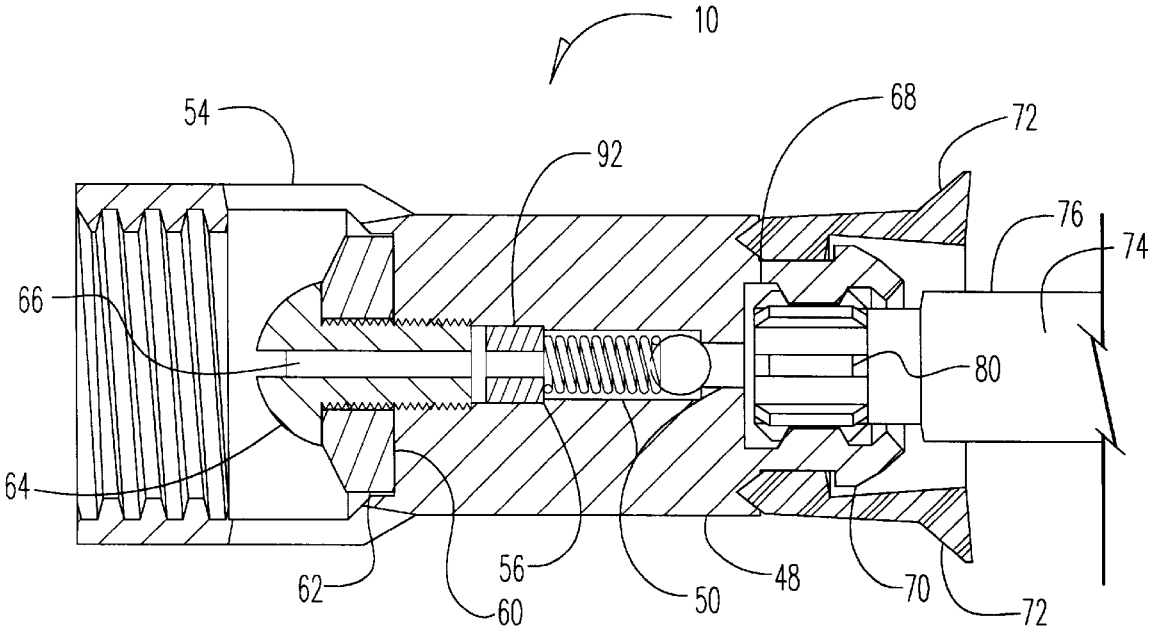
FIG. 3 is a sectional view similar to that of FIG. 2 but shows the check valve of this invention inserted into the valve body of FIG. 4 along with the inner end of the control rod being attached to the valve body.

Adjacent the interior end 22 of valve fitting 18 is a valve body 44 adapted for longitudinal movement in the interior end 14 of tube 12. Valve body 44 has an interior end 46, an exterior end 48 and an elongated center bore 50 extending therethrough (FIG. 2). A first annular shoulder 52 is located within center bore 50. Threaded arms 54 extend rearwardly from the body 44 and are adapted to threadably engage the threads 24 on the interior end 22 of valve fitting 18. A second annular shoulder 56 is located within center bore 50 rearwardly of the first annular shoulder 52. A third shoulder surface 58 is located around the inner end of bore 50 and functions as the bottom of recess 60 in which a conventional valve seating member 62 is located (FIG. 3). A rivet or screw 64 has a hollow center bore 66 and extends through valve seating 62 to be rigidly secured by either friction or threads to the interior end of bore 50.

A recess 68 is located in valve body 44 adjacent the outward end of bore 50. A plurality of spaced spline teeth 70 extend outwardly from recess 68. A conventional check valve member 72 extends around the spline teeth 70 and are adapted to engage the interior surface of the fluid inlet tube 12. The check valve member 72 conventionally permits fluid flow only in a direction towards the drain conduit 32, but prevents fluid flow in the inlet pipe in opposite direction.

A conventional elongated rod control 74 is located within the inlet pipe 12 and has a rearward end 76 and a forward end 78. Spline grooves 80 are formed in the rearward end 76 of the rod control and are adapted to engage the spline teeth 70 located at the forward end of the body 44. A conventional handle wheel 82 is mounted on the forward end 78 of rod control 74 and is held in place by conventional screw 84.

Figure 4:
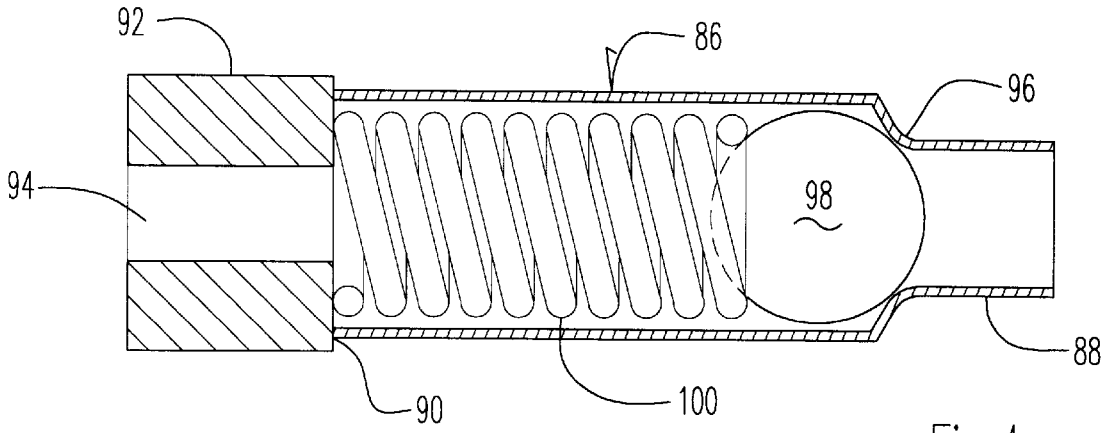
FIG. 4 is an enlarged scale sectional view through the check valve that is force fed into the bore of the valve body of FIGS. 2 and 3.
Figure 5:
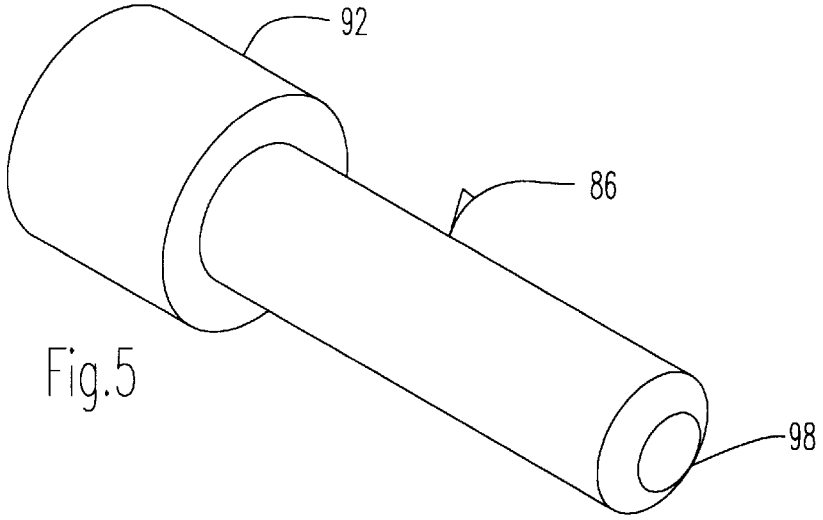
FIG. 5 is a perspective view of the check valve of FIG. 4 shown at a smaller scale.

As best shown in FIG. 4, a hollow valve body member 86 with a forward end 88 and rearward end 90 terminates at its rearward end in sleeve 92. Sleeve 92 has a bore 94 and is in communication with the hollow interior of body member 86 and the open forward end 96 of the body member. A spherical ball 98 is located in the forward end 88 of valve body 86 and is yieldingly held against the shoulder 52 to seal the bore 50 under normal operation of the hydrant. The compression spring 100 is compressed between ball 98 and the outer end of sleeve 92. The compressive strength of the spring is sufficient to hold the ball 98 in a sealing condition against shoulder 52 at all times when the pressure of fluid moving into inlet pipe 12 is no greater than the pressurized water flowing into the hydrant when the valve seating member 62 is in spaced condition with respect to the valve seat 26 (FIG. 1). In operation, the handle 82 is rotated to rotate rod 74 in a first direction to open the valve body 44 from sealing engagement with the valve seat 26 of the valve fitting 18. Pressurized water than flows through the hollow interior of valve fitting 18, thence around the valve body member 44 and the check valve 72, and thence through the interior body of the inlet tube 12 and thence outwardly through the fluid drain conduit 32. The flow of pressurized fluid through the hydrant is terminated when the rod 74 is rotated in the opposite direction to cause the valve seating member 62 to close on the valve seat 26.

In the event that a hose is attached to the fluid drain conduit 32 in freezing temperatures, the residual water which ordinarily would flow out of the conduit 32 if the hose were not attached when the valve member 42 is in a closed condition will be captured within the conduit 32 and the interior of tube 12. This residual captured water will first begin to freeze in the discharge conduit 32 and adjacent the exterior end 16 of tube 12. The presence of ice in that portion of the hydrant will cause excessive pressure possibly as high as 4,000 psi in unfrozen residual water in the end 14 of tube 12. This is because water volume expands by about 8% as it turns to ice. Ordinarily, water under that much pressure would rupture at least the inlet pipe 12. However, with the present invention, this increased pressure exerted on the residual water in the inlet pipe 12 occasioned by the formation of ice in the exterior end thereof will exert pressure on ball 98 and will compress the spring 100. Thus, the highly pressurized water will flow rearwardly through opening 96 in body 86, thence through the hollow interior of the body member 86, thence through the bore 94 in sleeve 92, thence through the hollow bore 66 and thence into the hollow interior of valve fitting 18. This flow of water will take place even though the valve fitting 18 may be filled with normally pressurized water. Again, with the force-fit relationship of the body member 86 within the bore 50 of body member 44, the ball 98 will not yield under normal pressurized water, but will yield and open only under the excessive pressure caused by the freezing in the hydrant as described above.

DESCRIPTION OF ALTERNATIVE EMBODIMENTS OF THE INVENTION

FIGS. 6–10 show alternative structures for use in lieu of valve body member 86.

Figure 6:
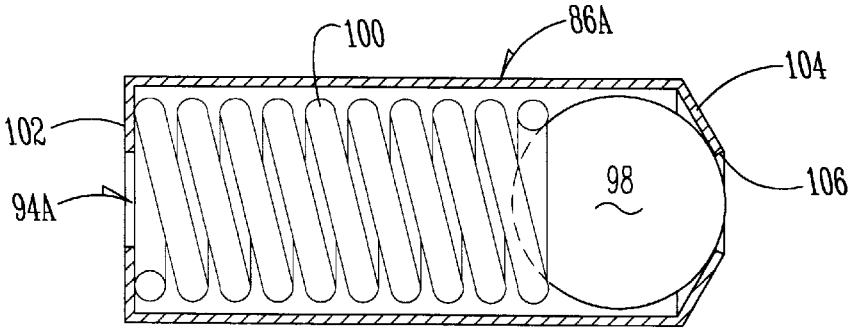
FIGS. 6–10 are views similar to FIG. 4 but show alternative structure to relieve high water pressure caused by ice in the hydrant.

In FIG. 6, a modified valve body 86A includes a ball 98 and spring 100 as shown in FIG. 4, but the spring 100 is contained on one end by wall 102. An aperture 94A is in wall 102 to permit the escape of water therethrough if high efficient pressure moves ball 98 off of seat 104 surrounding aperture 106.

Figure 10:
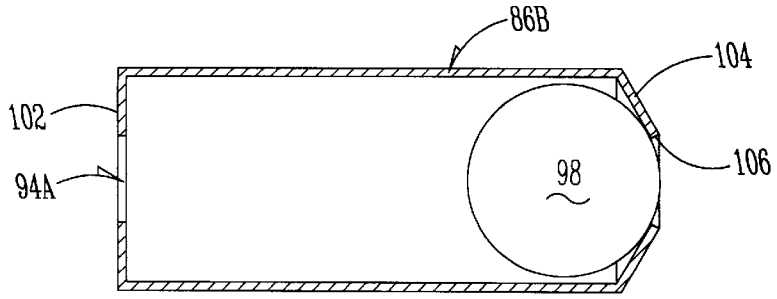

The device in FIG. 10 is similar to that of FIG. 6 except that the spring 100 has been eliminated from the valve body 86B. Normally, the water pressure on each side of ball 98 is the same. The pressure of inlet water will normally cause ball 98 to close on seat 104. However, if water pressure exerts excess pressure on the right-hand side of ball 98 through aperture 106, ball 98 will be unseated from seat 104 and the device will then relieve that excessive fluid pressure in the same manner as did the devices of FIGS. 4 and 6.

Figure 7:
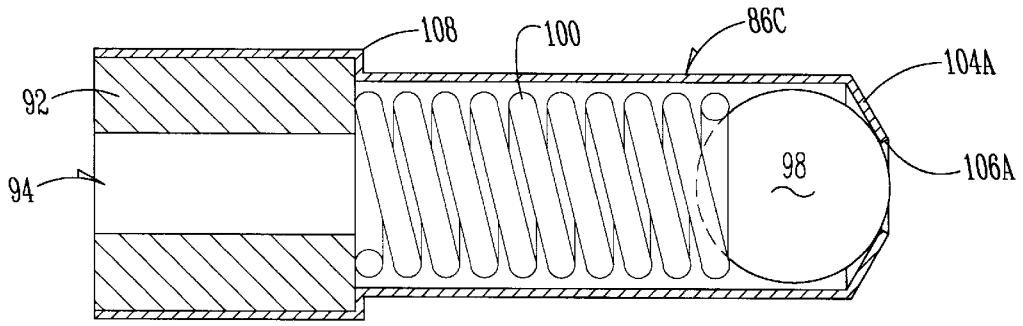

The device of FIG. 7 is similar to that of FIG. 4 except that the sleeve 92 is press fit into the enlarged shoulder structure 108 of valve body 86C. The forward end of body 86C is the same as in body 86B of FIG. 10 with ball seat 104A and aperture 106A. The device of FIG. 7 functions, as does the device of FIGS. 4 and 6.

Figure 8:
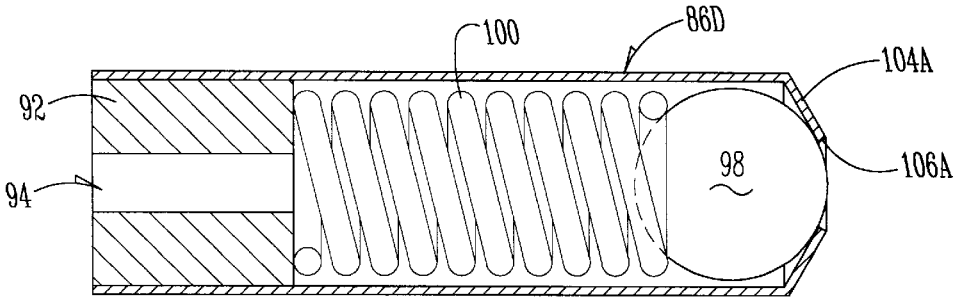

The device of FIG. 8 is the same as that shown in FIG. 7, but the valve body 86D of FIG. 8 has no shoulder structure 108.

Figure 9:
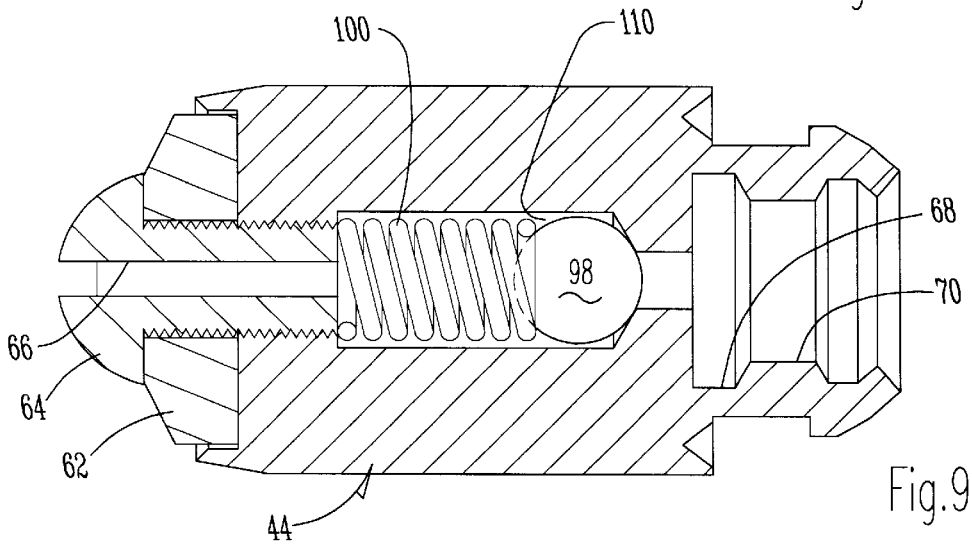

The device of FIG. 9 is similar to that of FIG. 6, except that no valve body 86A is used. Rather, the spring 100 and ball 98 are mounted in cavity 110 in conjunction with the valve seating member 62, and screw 64 with hollow center bore 66 of FIG. 3.

All of the alternative embodiments shown in FIGS. 6–10 allow the escape of fluid under high pressure to escape through the dislodged ball 98 for return to the water supply line when fluid pressure conditions on the other side of the ball are excessive.

Thus, from the foregoing, it is seen that this invention will keep the ordinary freezeless hydrant from becoming ruptured whenever a hose or the like is inadvertently left on the discharge conduit thereof. This successful result takes place because the formation of ice in such a hydrant under those conditions will permit the back flow of residual water in the hydrant to move through the otherwise closed hydrant valve into the original source of pressurized water. This relief of pressure will prevent the hydrant from rupturing under the freezing conditions. It is therefore seen that this invention will achieve all of its stated objectives.

What is claimed is:

1. A freezeless wall hydrant, comprising, a normally horizontal fluid inlet tube having an interior end and an exterior end, a hollow valve fitting rigidly secured to the interior end of the inlet tube for connection to a source of pressurized fluid, a valve seat on an interior end of the valve fitting, a casting member rigidly secured to the outer end of the inlet tube and including a drain conduit in communication with an interior of the inlet tube for discharging water from the hydrant, a valve body longitudinally movably mounted in the inlet tube adjacent the valve fitting, a valve seating element on the valve body adapted to engage and disengage the valve seat to prevent or permit, respectively, a fluid flow through the valve fitting into the inlet tube, an elongated operating rod having a rearward end secured to the valve body and an outer end protruding from the casting member for longitudinally moving the valve body in the inlet tube, a bore in the valve body connecting the valve fitting and the inlet tube, a spring loaded check valve in the bore of the valve body to normally prevent fluid flow either into or out of the inlet tube, the spring loaded check valve having an operating spring which will not allow fluid flow out of the inlet pipe into the valve fitting unless the fluid pressure in the inlet pipe is greater than the fluid pressure in the valve fitting when the valve seating member is seated on the valve seat, an annular shoulder is located in the bore of the valve body to serve as a second valve seat, the spring loaded check valve comprises a hollow cylindrical body with open interior and exterior ends, a compression spring in the hollow body and compressed to hold a valve seat member in fluid sealing engagement with the annular shoulder, the hollow cylindrical body being rigidly press-fit into the bore of the valve body;

the compression strength of the compression spring being predetermined to hold the valve seat member in sealing engagement with the annular shoulder unless the fluid pressure in the inlet pipe exceeds the normal fluid pressure in the valve fitting when the valve seating element is seated on the valve seating element on the valve body.

2. The hydrant of claim 1 wherein a second check valve is on the valve member to permit fluid flow only in a direction from the valve fitting into the inlet tube.

3. The hydrant of claim 1 wherein a vacuum breaker is mounted on the casting member and in fluid communication with the drain conduit.

4. The hydrant of claim 1 wherein the valve body is threadably engaged to the valve fitting so that manual rotation of the operating rod will longitudinally move the body member with respect the valve seat.

* * * * *